United States Patent [19]

Prosen

[11] 4,144,851

[45] Mar. 20, 1979

[54] VARIABLE COMPRESSION RATIO ENGINE

[75] Inventor: Gildo G. Prosen, Chicago, Ill.

[73] Assignee: Promac Corporation, Glenview, Ill.

[21] Appl. No.: 762,109

[22] Filed: Jan. 24, 1977

[51] Int. Cl.[2] ..... F02B 75/04

[52] U.S. Cl. ..... 123/78 C; 123/48; 123/78 AA

[58] Field of Search ..... 123/48 R, 48 C, 78 R, 123/78 AA, 78 C

[56] References Cited

U.S. PATENT DOCUMENTS

| | | | |
|---|---|---|---|
| 752,936 | 2/1904 | Vogt | 123/78 AA |
| 1,360,366 | 11/1920 | Charter | 123/48 C |
| 1,979,746 | 11/1934 | Kenneweg | 123/78 AA |
| 2,206,027 | 7/1940 | Butler | 127/78 AA |
| 2,414,217 | 1/1947 | Weiss et al. | 123/78 AA |

FOREIGN PATENT DOCUMENTS

| | | | |
|---|---|---|---|
| 2504919 | 8/1976 | Fed. Rep. of Germany | 123/78 R |
| 150079 | 10/1931 | Switzerland | 123/78 AA |

*Primary Examiner*—Charles J. Myhre
*Assistant Examiner*—David D. Reynolds
*Attorney, Agent, or Firm*—Vogel, Dithmar, Stotland, Stratman & Levy

[57] ABSTRACT

A two-part variable compression ratio cylinder is provided having inner and outer sleeves wherein relative movement between the sleeves varies the volume of the combustion chamber and hence varies the compression ratio of the engine. Hydraulic means responsive to the pressure in the combustion chamber automatically varies the position of the inner and outer sleeves to regulate the combustion chamber volume. The cylinder is adaptable to engines of any type.

14 Claims, 6 Drawing Figures

VARIABLE COMPRESSION RATIO ENGINE

BACKGROUND OF THE INVENTION

The present invention relates to an internal combustion engine, particularly to such engines employing means for varying the compression ratio thereof and more particularly to improved means for controlling relative movement of two-part cylinders for such engines. Variable compression ratio (VCR) engines are well known in the art and variations thereof are disclosed in U.S. Pat. No. 2,215,986 issued Sept. 24, 1940 to Stevens, U.S. Pat. No. 2,375,183 issued May 8, 1945 to Arden, U.S. Pat. No. 2,419,450 issued Apr. 22, 1947 to Howard and U.S. Pat. No. 2,769,433 issued Nov. 6, 1956 to Humphreys.

In each of the aforesaid patents, a VCR engine is disclosed in which the combustion chamber volume is varied either by adjusting the piston shape or path or by adjusting the cylinder volume. However, none of the referred to patents shows or suggests the two-part cylinder of the present invention in which an integral combustion chamber is formed by the inner cylinder and the piston, thereby minimizing the loss combustion pressure.

The present invention provides a construction wherein the loss of combustion pressure is minimized and also a construction wherein the loss of hydraulic fluid or oil is also minimized. Moreover, the present invention is relatively simple to construct and can be adapted to a wide variety of internal combustion engines.

SUMMARY OF THE INVENTION

This invention relates to a VCR engine and more particularly to a VCR engine in which the combustion chamber is constructed to provide minimum possibilities for escape of the gases during combustion to enhance the efficiency of the engine.

An important object of the present invention is to provide a VCR engine in which a two-part cylinder including inner and outer sleeves is utilized automatically to adjust and control the combustion chamber volume as well as the effective area of the inlet and outlet ports.

Another object of the present invention is to provide a VCR engine in which the loss of oil is minimized by the construction provided.

Still another object of the present invention is to provide a construction for adapting a wide variety of internal combustion engines to the VCR type without adding cumbersome and complicated mechanism.

Another object of the present invention is to provide an internal combustion engine having a combustion chamber, means for automatically varying the volume of the combustion chamber, comprising a cylinder having inner and outer sleeves, the inner sleeve defining at least a portion of the combustion chamber, means providing relative movement between the inner and outer sleeves to vary the volume of the combustion chamber, the means being responsive to pressure in the combustion chamber to increase the combustion chamber volume in response to an increase in pressure and to decrease the combustion chamber volume in response to a decreasing pressure.

Still another object of the present invention is to provide an internal combustion engine of the type set forth in which first and second fluid chambers are formed by the inner and outer sleeves and means connecting the first and second fluid chambers to a fluid supply providing a constant source of fluid to the chambers.

A further object of the present invention is to provide an internal combustion engine of the type set forth in which the inner chamber has an integral closed end forming a unitary combustion chamber in combination with the piston head.

A still further object of the present invention is to provide an internal combustion engine having a combustion chamber, means for automatically varying the volume of the combustion chamber comprising, a cylinder having inner and outer sleeves, the inner sleeve having an integral closed end forming with an associated piston a unitary combustion chamber and having an outwardly extending annular portion, the outer sleeve having an inwardly extending annular portion the upper surface thereof mating with the lower surface of the inner sleeve annular portion, the inner and outer sleeves and the annular portions thereof in combination with a cylinder head forming upper and lower chambers, means connecting the upper and lower chambers to an associated source of fluid and providing fluid under pressure to the upper and lower chambers, means for maintaining the fluid in the upper chamber at a higher pressure than the fluid in the lower chamber when the engine load is less than a preselected value, and means for releasing the fluid in the upper chamber in response to an engine load in excess of the preselected value to permit relative movement between the inner and outer sleeves to increase the combustion chamber size, thereby decreasing the compression ratio.

Still further objects and advantages of the present invention will be readily apparent upon reference to the following description of several preferred embodiments thereof and which refers to the accompanying drawings:

DESCRIPTION OF THE PREFERRED EMBODIMENTS

Figures 1, 2:
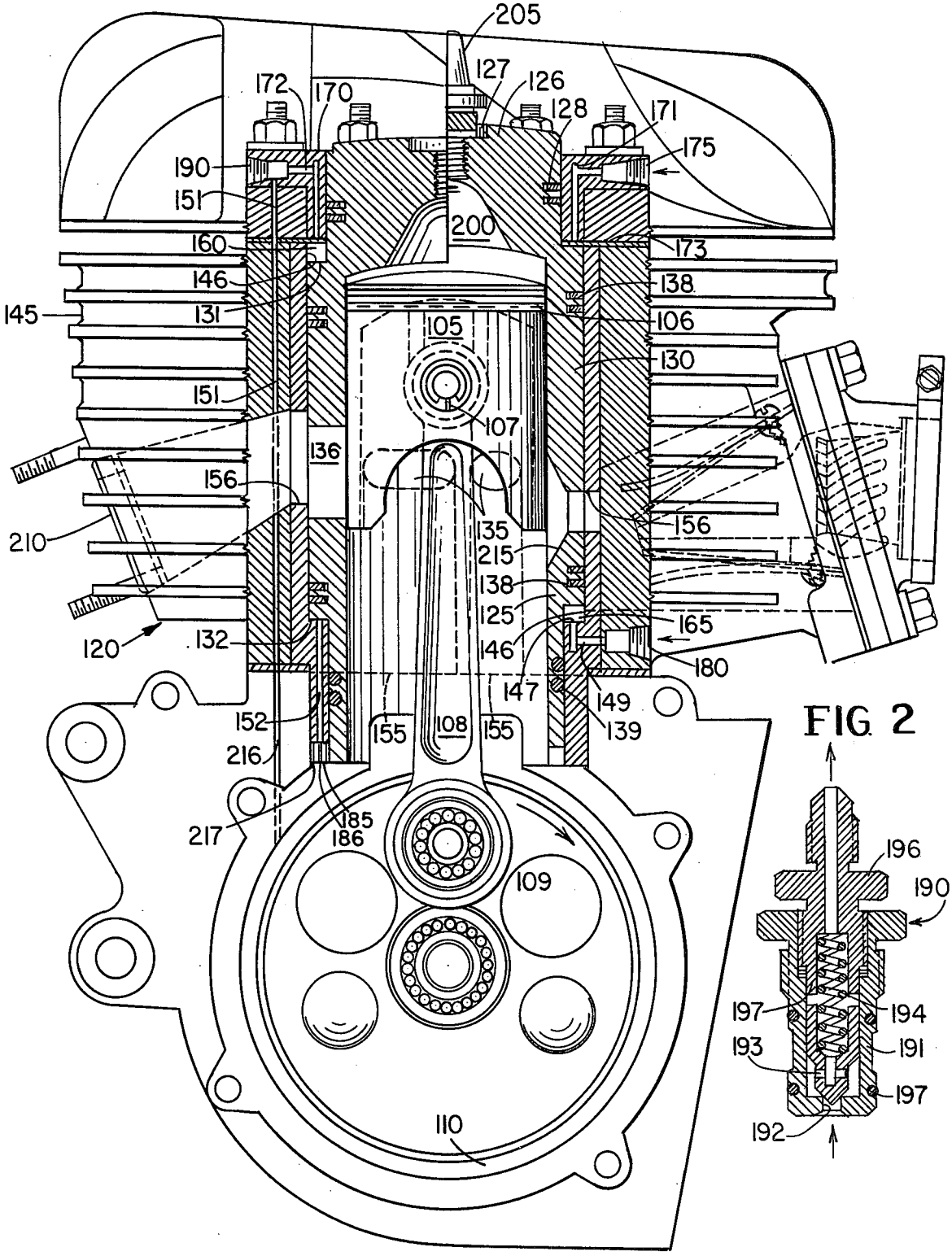
FIG. 1 is a vertical cross section view taken through the axis of a VCR piston, cylinder and crank case embodying the construction of the present invention.
FIG. 2 is a vertical cross section view of a pressure release valve used with the present invention.

Referring now to FIGS. 1 and 2, there is disclosed a two-stroke internal combustion engine 100 having a piston 105 with the usual rings 106. A connecting rod 108 interconnects the piston pin 107 with the crank 109 in the crank case 110, all in the usual manner.

A two-part cylinder 120 is provided with an elongated inner sleeve 125 having an upstanding closed top portion 126 which accommodates a spark plug seat 127 therein. The top portion 126 of the inner sleeve 125 is provided with rings 128 of the same type used for the piston rings 106. The inner sleeve 125 of the two-part cylinder 120, has extending outwardly therefrom an integral annular flange 130 having an upper surface 131 and a lower surface 132. Apertures 135 extend through the cylindrical inner sleeve 125 and another aperture 136 extends through the side of the cylindrical sleeve 125. Above and below the apertures 135 and 136 are provided rings 138 in the annular flange portion 130 and gaskets or O-rings 139 in the portion of the cylindrical sleeve 125 below the annular flange portion 130. The rings 128 and 138 may be metal or Teflon-type material.

The two-part cylinder 120 also includes an outer sleeve 145, which outer sleeve is cylindrical in shape with an inner cylindrical wall or surface 146 and an inwardly extending abutment surface 147, the abutment surface 147 being adapted to fit snugly against the inner sleeve 125 and particularly the surface 132 thereof. A passageway 149 extends inwardly through the sleeve 145 near the bottom thereof, for a purpose hereinafter set forth. On the other side of the outer sleeve 145, there are provided oil passageways 151 and 152 extending vertically through the cylindrical sleeve 145, with the passageway 152 interior of the passageway 151 and interconnecting the surface 147 of the sleeve 145 with the bottom surface of the sleeve.

The outer sleeve 145 is further provided with a gas passageway 155 which extends from the bottom surface of the outer sleeve to a position in registry with the aperture or port 135 of the inner sleeve 125. Similarly, another aperture 156 is provided extending through the sleeve 145 in alignment with the aperture 136 in the inner sleeve 125.

The inner sleeve 125 and the outer sleeve 145 which comprise the two-part cylinder 120, cooperate to form an upper chamber 160 defined by the annular surface 131 of the inner sleeve 125 and the cylindrical inner surface 146 of the outer sleeve 145 and the bottom surface 173 of the cylinder head 170. A lower chamber 165 is also formed between the inner sleeve 125 and the outer sleeve 145 and is defined by the annular surface 132 of the inner sleeve, the abutment surface 147 of the outer sleeve and the cylindrical inner side wall or surface 146 of the outer sleeve 145. While the total volume of the chambers 160 and 165 remains constant, the individual volumes vary depending upon the position of the inner sleeve 125 with respect to the outer sleeve 145.

The annular cylinder head 170 fits snugly around the top portion 126 of the inner cylinder 125 and rests on the upper surface of the outer sleeve 145, gaskets being provided to form a seal between the cylinder head 170 and the outer sleeve 145, with the rings 128 sealing the head 170 and the inner sleeve 125. Provided in the cylinder head 170 is an oil passageway 171 in communication with the upper chamber 160 and with a one-way valve 175 also in communication with the upper chamber 160. Also provided in the cylinder head 170 is an oil passageway 172 interconnecting the upper chamber 160 and the oil passageway 151 in the outer sleeve 145. A one-way valve 180 is provided between the passageway 149 and the lower chamber 165. A restrictor valve 185 having a reduced diameter aperture 186 therein is in fluid communication with the lower chamber 160 by means of the oil passageway 152 to permit constant flow of hydraulic fluid therethrough.

Finally, there is provided a pressure release valve 190 positioned inside the cylinder head 170 in fluid communication with the upper chamber 160 by means of the passageway 172. The pressure release valve 190 is more clearly illustrated in FIG. 2 and includes a valve body 191 generally cylindrical in shape and defining a valve seat 192 in the form of an aperture at one end of the body. A valve 193 fits inside the cylindrical body 191 and has a portion thereof adapted to fit within the valve seat 192 and seal same. A spring 194 is positioned between the valve 193 and a threaded adjustment member 196 thereby to provide constant pressure urging the valve 193 into engagement with the seat 192 to seal same. Gaskets or O-rings 197 are provided on the outer surface of the valve body 191 to prevent leaking of hydraulic fluid around the valve 190.

A combustion chamber 200 is defined between the inner surface of the top portion 126 of the inner sleeve 125 and the piston 105. A standard spark plug 205 positioned in the usual manner in the spark plug seat 127 extends into the combustion chamber 200 and operates in the usual manner. An exhaust system 210 is in fluid communication with the interior of the cylinder 120 by means of the aligned apertures 136 and 156. Finally, an intake passageway 215 in registry with the passageway 155 interconnects the crank case 110 with the inside of the two-part cylinder 120 via the passageways 135 and 155; a passageway 216 in registry with the pressure release valve 190 provides communication between the upper chamber 160 and the crank case 110; a passageway 217 in registry with the restrictor valve 185 interconnects the crank case 110 and the lower chamber 165; and finally a conduit (not shown) provides communication between the crank case 110 and the one-way valves 175 and 180 respectively and hence with both the upper chamber 160 and the lower chamber 165. An oil pump (not shown) provides a constant oil supply via the passageways 149 and 171 to the upper and lower chambers 160 and 165.

As seen, the system is a continuous loop with oil from the crank case 110 flowing to the chambers 160 and 165 and then being returned to the crank case, all as will hereinafter be set forth.

When the engine 100 is started, the parts are in the high compression position. Since the restrictor valve 185 provides a continuous drain of motor oil from the lower chamber 165 to the crank case 110, at rest the inner sleeve 125 will move to the position illustrated, since the oil pressure in chamber 165 is less than the pressure in chamber 160. In the position illustrated, the inner sleeve 125 is in its lower position and the combustion chamber 200 is at its smallest volume, whereby the engine compression ratio is the highest attainable. This is an advantageous position for start-up and at light engine loads.

When the engine 100 is started, the oil pump (not shown) in communication with the oil supply in the crank case 110 pumps oil through the enumerated passageways to the one-way valve 175 to maintain a constant oil pressure at the one-way valve 175 and to provide a constant oil supply to the upper chamber 160. Oil in the upper chamber 160 flows therefrom through the passageways 172 to the pressure release valve 190. The pressure release valve 190 is preset to a predetermined pressure, such as 90% of the maximum operating pressure in the combustion chamber 200. Accordingly, until the preset pressure is obtained, the pressure release valve 190 remains closed and prevents oil from escaping the chamber 160, thereby maintaining the inner sleeve 125 in the lower position thereof, as illustrated in FIG. 1.

When the load on the engine 100 increases, the pressure within the combustion chamber 200 rises and when it passes the preset pressure of the pressure release valve 190, the spring 194 compresses thereby separating the valve 193 from the seat 192 allowing oil to escape from the upper chamber 160 to the crank case 110. The oil flow through the pressure release valve 190 is greater than through the restrictor valve 185, while the oil supply to the valve 175 and 180 remains the same. So long as the pressure release valve 190 is open, the volume of oil escaping chamber 160 will exceed the volume of oil escaping chamber 165, whereby the inner sleeve 125 will move upwardly with respect to the outer sleeve 145, and the volume of chamber 165 will increase, while the volume of chamber 160 decreases.

So long as the pressure in the combustion chamber 200 is sufficient to maintain the pressure release valve 190 open, the inner sleeve 125 will move upwardly toward the cylinder head 170 until the inner sleeve reaches its uppermost position. Thereafter, for as long as the pressure in the combustion chamber 200 exceeds the preset pressure of the valve 190, the inner sleeve 125 will remain in its uppermost position relative to the outer sleeve 145. The spring 194 may be adjusted to control the flow rate of oil through the valve 190, such that an equilibrium can be attained with the sleeve 125 at an intermediate position with respect to the sleeve 145. In this case, if the engine load increases with a concurrent increase in pressure in the combustion chamber 200, then more hydraulic oil will be forced out of the upper chamber 160 and the inner sleeve 125 will move upwardly into its most upward position in which the surface 131 of the sleeve 125 is in engagement with the bottom surface 173 of the cylinder head 170, at which time the lower chamber 165 volume will be at its maximum. At this time, the compression ratio of the motor will be at its lowest, since the load on the motor will be the greatest. This provides increased operating efficiency resulting in the least amount of fuel being used to run the engine 100.

As the load decreases, beyond the point where the pressure in the combustion chamber 200 is less than the preset value of the pressure release valve 190, the valve 190 will close and thereafter hydraulic fluid will be retained in the upper chamber 160 and the volume thereof will steadily increase until a new equilibrium is attained. The pressure release valve 190 may open and close rapidly in order to accommodate relatively rapid changes in the engine load, whereby intermediate positions of the inner sleeve 125 with respect to the outer sleeve 145, will be obtained. In all cases, after the engine is shut-off, the inner sleeve will move to the high compression position due to the continuing bleed through the resistor 185 and hence the engine 100 will be in the high compression ratio position upon starting, a desirable characteristic.

It will be seen therefore that the engine 100 automatically adjusts between a high compression ratio condition at low engine loads and a low compression ratio condition at high engine loads to reduce engine wear, improve power output and conserve fuel. Another advantage of the present invention is the construction of the combustion chamber 200 formed by the inner surface of the inside sleeve 125 and the top of the piston 105, which combustion chamber 200 is sealed as in a normal non-VCR engine, thereby preventing undue escape of combustion gases with the resultant loss in engine power and efficiency. This is an extremely important characteristic, since the gases in the cylinder sleeve 125 at combustion, cannot escape and must perform work on the piston 105, whereas in prior art construction the variable cylinder designs presents many areas through which combustion gases at high pressure can escape, thereby resulting in lower power output and inefficient operation.

Another feature of the present invention is the simplified hydraulic system which utilizes a state-of-the-art oil pump in the crank case 110 to provide all required hydraulics of the engine 100. This improved design is a fundamental feature of the present invention, since no intricate and expensive equipment is needed to transform a normal engine into the VCR engine of the present invention. It will be seen that adjustment of the pressure release valve 190 determines the combustion pressure or engine load necessary to cause relative movement between the inner and outer sleeves 125 and 145 respectively. The rapidity of oscillation of the inner sleeve 125 between the high compression and low compression position, is controlled by both the aperture 186 in the restrictor 185 and a smaller aperture having a greater dampening effect than a larger aperture. In all other respects, the present VCR engine 100 requires no additional seals beyond those normally present in a usual engine, the seals and O-rings 138 and 139 being of the normal type presently employed in internal combustion engines.

Figure 3:
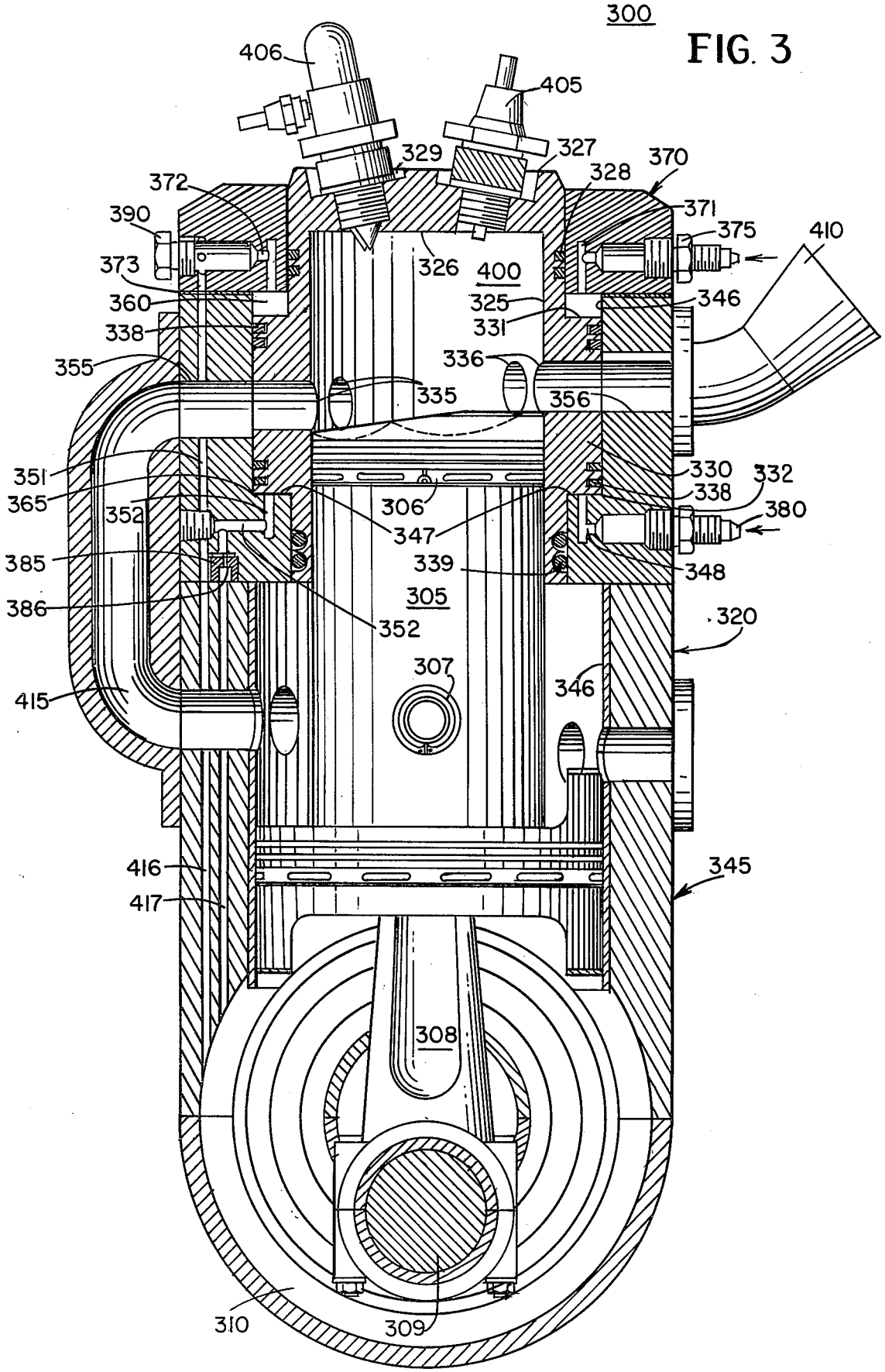
FIG. 3 is a vertical cross section view of a VCR engine cylinder showing a tandem piston.

Referring now to FIG. 3, there is disclosed a two-stroke, tandem piston engine 300 useful in two cycle V-8 engines as well as 2 cycle in-line engines. The two-stroke engine 300 is provided with a piston 305 and the usual rings 306. A connecting rod 308 interconnects the piston pin 307 with the crank 309 in the crank case 310, all in the usual manner.

A two-part cylinder 320 is provided with an elongated inner sleeve 325 having an upstanding closed top portion 326 which accommodates a spark plug seat 327 and a fuel injection seat 329. The top portion 326 of the inner sleeve 325 is provided with the usual rings 328, of the same type previously described for the piston rings 306. The inner sleeve 325 of the two-part cylinder 320 has extending outwardly therefrom an integral annular flange 330 having an upper surface and a lower surface 332. An aperture 335 extends through one side of the cylindrical inner sleeve 325 and another aperture 336 extends through the opposite sides of the sleeve 325. Above and below the apertures 335 and 336 are provided rings 338 in the annular flange portion 330 and O-rings 339 in the portion of the cylindrical sleeve 325 below the annular flange.

The two-part cylinder 320 also includes an outer sleeve 345, which is cylindrical in shape with an inner cylindrical wall or surface 346 and an inwardly extending abutment surface 347, the abutment surface 347 being adapted to fit snugly against the inner sleeve 325 and particularly the surface 332 thereof. An oil passageway 348 is provided in the outer sleeve 345 and extends vertically upwardly to the surface 347. On the other side of the sleeve 345, there are provided oil passageways 351 and 352, with the passageway 351 extending vertically through the outer sleeve 345 and the passageway 352 extending from the surface 347 downwardly, for a purpose to be explained.

The outer sleeve 345 is further provided with a gas passageway 355 which is in alignment with the opening 335 and the inner sleeve and is in communication with an air intake. Similarly, another aperture 356 is provided extending through the sleeve 345 and in alignment with the aperture 336 in the inner sleeve 325.

The inner sleeve 325 and the outer sleeve 345 which comprise the two-part cylinder 320 cooperate to form an upper chamber 360 defined by the annular surface 331 of the inner sleeve 325 and the cylindrical inner surface 346 of the outer sleeve 345 and the bottom surface 373 of the cylinder head 370. A lower chamber 365 is also formed between the inner sleeves 325 and the outer sleeve 345 and is defined by an annular surface 332 of the inner sleeve, the abutment surface 347 of the outer sleeve and the cylindrical inner side wall or surface 346 of the outer sleeve 345. While the total volume of the chambers 360 and 365 remains constant, individual volumes vary depending upon the position of the inner sleeve 325 with respect to the outer sleeve 345.

An annular cylinder head 370 fits snugly around the top portion 326 of the inner cylinder 325 and rests on the upper surface of the outer surface 345, gaskets (not shown) being provided to form a seal between the cylinder head and the outer sleeve 345, with the rings 328 sealing the head 370 and the inner sleeve 325. Provided in the cylinder head 379 is an oil passageway 371 in communication with the upper chamber 360. Also provided in the cylinder head 370 is an oil passageway 372 in communication with the upper chamber 360. A one-way valve 375 is provided between the upper chamber 360 and a source of oil pressure (not shown). Specifically, the one-way valve 375 is in fluid communication with the passageway 371 and with an oil pump for pumping oil from the crank case 310. Another one-way valve 380 is provided in fluid communication with the lower chamber 365 and also in fluid communication with the same pump as the one-way valve 375. A restrictor valve 385 having a reduced diameter aperture 386 therein is in fluid communication with the lower chamber 365 by means of the oil passageway 352 to permit a constant flow of hydraulic fluid therethrough.

Finally, there is provided a pressure release valve 390 positioned in communication with the upper chamber 360 and specifically the passageway 372. The pressure release valve 390 is intermediate the upper chamber 360 and the passageway 351 extending through the outer sleeve 345.

A combustion chamber 400 is defined between the inner surface of the top portion 326 of the inner sleeve 325 and the piston 305. A standard igniter 405 is positioned in the usual manner in the spark plug seat 327 and a fuel injector 406 is positioned in the standard manner in the seat 329 therefore. An exhaust system 410 is in fluid communication with the interior of the cylinder 320 by means of the aligned apertures 336 and 356. Finally, an intake passageway 415 provides communication between the combustion chamber 400 and a source of air, which is useful if a carburetor is used rather than the fuel injection shown; a passageway 416 in registry with the pressure release valve passageway 351 provides communication between the upper chamber 360 and the crank case 310; the passageway 417 in registry with the restrictor valve 385 provides communication between the crank case 310 and the lower chamber 365. As before stated, an oil pump (not shown) provides a constant oil supply to both the one-way valves 375 and 380.

Operation of the engine 300 is substantially the same as previously described with respect to engine 100, the fundamental difference being merely in the engine design rather than in the two-part cylinder 320. In the engine 300, the spark plug 405 is used to initiate combustion, and thereafter, combustion is continual by compressing gases in a well known manner. The engine 300 may be fitted with a carburetor rather than the fuel injector 406, but this is standard in the art and is shown merely to illustrate the complete adaptability of the present VCR engine. The inner and outer sleeves 325 and 345 respectively, operate in exactly the same manner as previously set forth with respect to the engine 100, an added feature being the outside location of all valves 375, 380 and 390, which facilitates repair of these valves if necessary.

Figure 4:
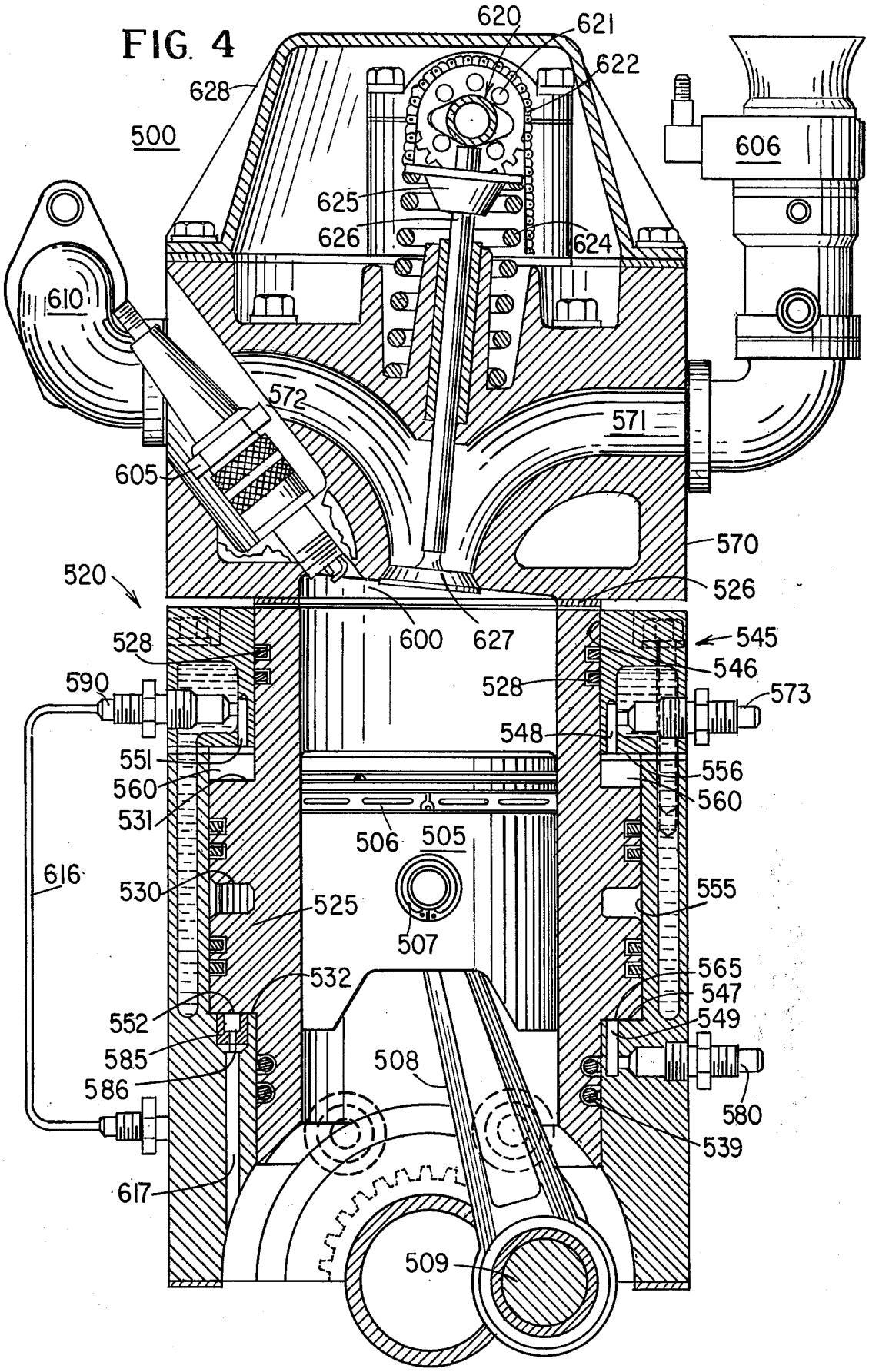
FIG. 4 is a vertical cross section view of an overhead cam four stroke VCR engine.

Referring now to FIG. 4, there is illustrated a four-stroke overhead cam engine 500, which may be used in a V configuration, or a star or in an in-line formation. The overhead cam engine 500 has a piston 505 with usual piston rings 506. A connecting rod 508 interconnects the piston pin 507 with the crank 509 in the crank case, all in the usual manner.

A two-part cylinder 520 is provided with an elongated inner sleeve 525 having an upstanding portion with a gasket 526 on the top thereof. The upstanding portion of the inner sleeve 525 is provided with rings 528 of the same type used for the piston 505. The inner sleeve 525 of the two-part cylinder 520, has extending outwardly therefrom an integral annular flange 530, which may be a single piece or spaced apart as shown, the annular flange 530 having an upper surface 531 and a lower surface 532. Spaced apart rings 538 are provided in the annular flange 530 as well as gaskets 539 on the lower portion of the inner sleeve 525.

The two-part cylinder 520 also includes an outer sleeve 545, cylindrical in shape, with an inner cylindrical wall or surface 546 and an inwardly extending abutment surface 547, the abutment surface 547 being adapted to fit snugly against the inner sleeve 525 and particularly the lower surface 532 thereof. An oil passageway 548 extends vertically through the outer sleeve 545 and particularly is in communication with the lower horizontal surface of the upper portion of the outer sleeve 545. There is also provided an oil passageway 549 which is in communication with the upper surface of the bottom enlarged portion of the outer sleeve 545, all for a purpose hereinafter set forth. On the other side of the outer sleeve 545 there is provided an oil passageway 551 in communication with the same surface as the passageway 548 and similarly a passageway 552 in communication with the same surface as the passageway 549.

The inner sleeve 525 and the outer sleeve 545 which comprise the two-part cylinder 520, cooperate to form an upper chamber 560 defined by the annular surface 531 of the inner sleeve 525 and the side cylindrical surface 555 of the outer sleeve 545 and the upper abutment surface 556 of the outer sleeve 545. A lower chamber 565 is also formed between the inner sleeve 525 and the outer sleeve 545 and is defined by the annular surface 532 of the inner sleeve, the abutment surface 547 of the outer sleeve and the cylindrical inner side wall 546 of the outer sleeve. While the total volume of the chambers 560 and 565 remains constant, the individual volumes vary as previously described.

A cylinder head 570 sits on top the inner sleeve 525 and particularly the gasket 526 thereof. The cylinder head 570 has an inlet port 571 and exhaust port 572. The overhead cam assembly 620 is positioned in the cylinder head 570 and includes a gear 621 having a chain 622, in the usual fashion, the valve 627 being connected to the stem 626 and being provided with a spring 624 and spring retainer 625, all as well known in the art. The cylinder head 570 is provided with an overhead cam cover 628 firmly connected to the cylinder head as in standard fashion.

There is further provided a one-way valve 575 in fluid communication with the upper chamber 560 via the passageway 548, the one-way valve 575 also being connected to a constant source of high pressure hydraulic fluid (not shown). Another one-way valve 580 is positioned in fluid connection with the lower chamber 565 via the passageway 549, the one-way valve 580 like the one-way valve 575, being connected to a source of hydraulic fluid. A restrictor valve 585 having a reduced diameter aperture 586 extending therefrom is in fluid communication with the lower chamber 565 and permits continual draining of hydraulic fluid from the chamber, thereby to ensure a lower hydraulic pressure in chamber 565, than in chamber 560, when the valve 590 is closed.

The pressure release valve 590 is in fluid communication with the upper chamber 560 via the passageway 551 and is connected via means to be described hereinafter to the crank case. A combustion chamber 600 is defined between the inner surface of the cylinder head 570 and the piston 505. A standard spark plug 605 positioned in the usual manner extends into the combustion chamber 600 and operates in the usual fashion. An exhaust system 610 is in fluid communication with the interior of the cylinder 520 and particularly via the combustion chamber 600. Finally, a tube 616 connects the pressure release valve 590 via a fixture to the crank case; a passageway 617 interconnects the restrictor valve 585, the lower chamber 565 and the crank case; and connection means (not shown) connect each of the one-way valves 575 and 580 with the crank case, thereby to provide a constant source of hydraulic fluid to both the upper and lower chambers 560 and 565, respectively.

Operation of the overhead cam four-stroke engine is standard with the exception that the present engine 500 is provided with the VCR mechanism of the present invention. Specifically, the inner and outer sleeves 525 and 545 respectively operate in the same manner as hereinbefore described in combination with the carburetor 606, the spark plug 605 and other mechanisms, not shown, cause combustion in the combustion chamber 600. Since vertical movement of the sleeve 525 with respect to the fixed sleeve 545 is only on the order of about 0.187 to about 0.218 of an inch, elaborate mechanisms is not needed to accommodate the movement of the cylinder head 570 and the cam assembly 620 mounted thereon. This is a distinct advantage of the present invention, which may be adapted for use with a wide variety of engines.

Figure 6:
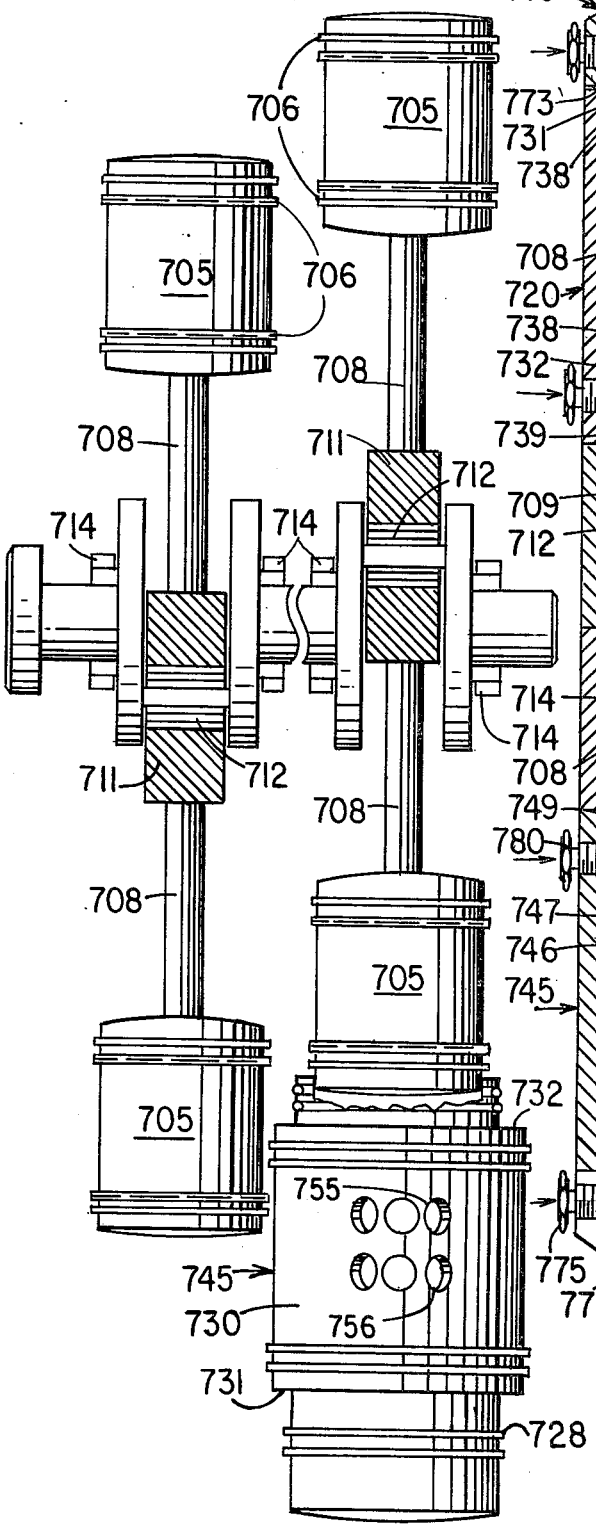
FIG. 6 is a plan view of the piston cylinder and power train assembly of the engine shown in FIG. 5.
Figure 5:
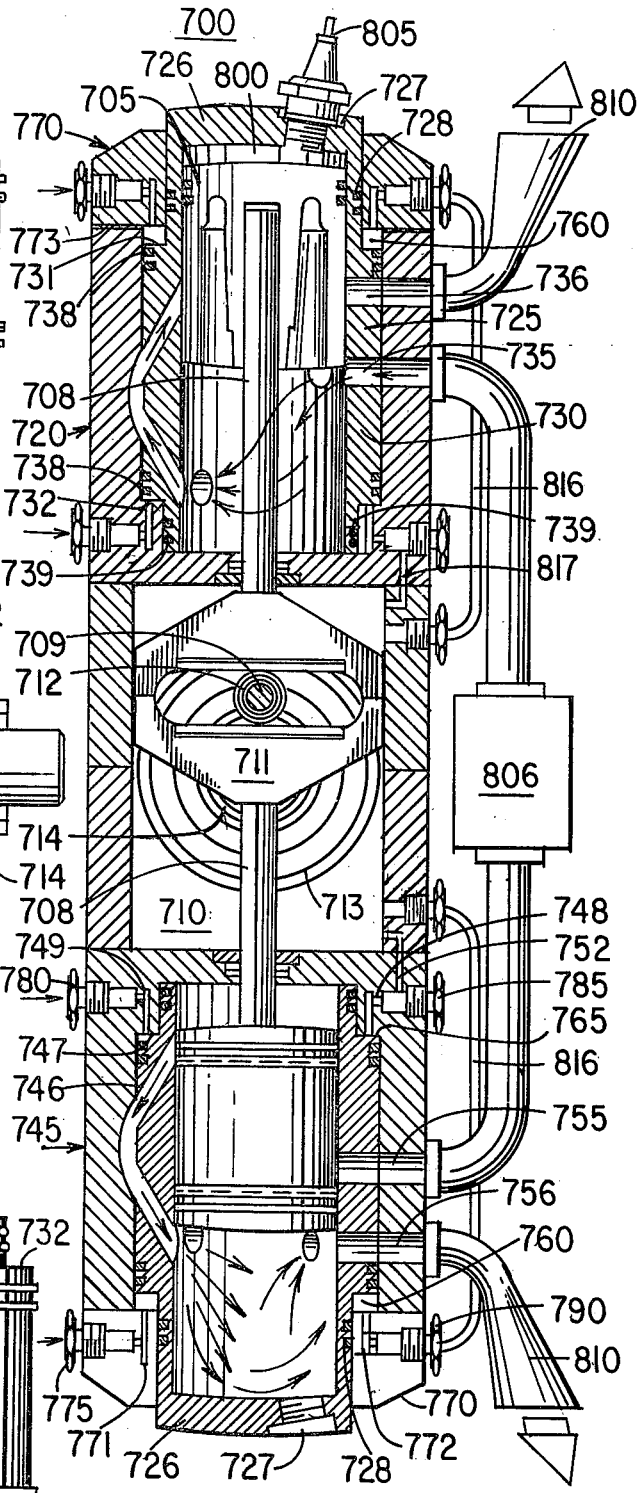
FIG. 5 is a vertical cross section view of a non-rotating bouncing piston VCR engine.

Referring now to FIGS. 5 and 6, there is disclosed a bouncing piston engine 700, the engine 700 being illustrated with two pistons 705 and two complete sets of cylinders 720. For the sake of brevity, only one section of the engine 700 will be described, it being understood that two pistons 705 are arranged as illustrated for each pair of cylinders and cooperate as hereinafter described. An engine 700 may be provided with any number of pairs of pistons and cylinders desired. A connecting rod 708 interconnects the associated piston pin 707 with the associated crank 709, which is located in the crank case 710, all in the usual manner. In the bouncing piston engine 700, the usual rotation does not occur and the associated parts are arranged so that one piston is compressing while the other piston is being forced downward due to the combustion in that chamber. Accordingly, each piston 705 is connected to a crankhead 711 associated with a journal bearing 712 connecting the crank counter weight wheel 713 positioned on the main bearing 714 to the connecting rod 708. In this manner, the bouncing of each pair of pistons 705 results in rotation of the crank shaft in the main shaft bearing 714.

A two-part cylinder 720 is provided with an elongated inner sleeve 725 having an upstanding closed top portion 726 which accommodates a spark plug seat 727 therein. The top portion 726 of the inner sleeve 725 is provided with rings 728 of the same type used for the piston rings 706, or Teflon-like rings may be substituted. The inner sleeve 725 of the two-part cylinder 720 has extending outwardly therefrom an integral annular flange 730 having an upper surface 731 and a lower surface 732. An aperture 735 extends through one side of the cylindrical inner sleeve 725 and another aperture 736 extends through the same side positioned upwardly of the aperture 735. Above and below the apertures 735 and 736 are provided rings 738 in the annular flange portion 730, and O-rings 739 are provided in a portion of the cylindrical sleeve 725 below the annular flange portion 730.

The two-part cylinder 720 also includes an outer sleeve 745, which outer sleeve is cylindrical in shape with an inner cylindrical wall or surface 746 and an inwardly extending abutment surface 747, the abutment surface 747 being adapted to fit snugly against the inner sleeve 725 and particularly, the surface 732 thereof. An oil passageway 749 is provided in the outer sleeve and extends to the abutment surface 747 thereof. Another oil passageway 752 is provided in the outer sleeve 745 and interconnects the outer sleeve with the crank case 710, as hereinafter will be set forth.

The outer sleeve 745 is further provided with a gas passageway 755 which extends through the outer sleeve 745 and is in registry with the aperture 735 in the inner sleeve 725. Similarly, another aperture 756 in the outer sleeve 745 extends therethrough and is in registry with the aperture 736 in the inner sleeve 725.

The inner sleeve 725 and the outer sleeve 745 which comprise the two-part cylinder 720, cooperate to form an upper chamber 760 defined by the annular surface 731 of the inner sleeve 725 and the cylindrical inner surface 746 of the outer sleeve 745 and the bottom surface 773 of the cylinder head 770. A lower chamber 765 is also formed between the inner sleeve 725 and the outer sleeve 745 and is defined by the annular surface 732 of the inner sleeve, the abutment surface 747 of the outer sleeve and the cylindrical inner side wall or surface 746 of the outer sleeve. While the total volume of the chamber 760 and 765 remains constant, the individual volumes vary depending upon the position of the inner sleeve 725 with respect to the outer sleeve 745.

The annular cylinder head 770 fits snugly around the top portion 726 of the inner cylinder 725 and rests on the upper surface of the outer sleeve 745, gaskets (not shown) being provided to form a seal between the cylinder heads 770 and the outer sleeve 745, with the rings 728 sealing the heads 770 and the inner sleeve 725. Provided in the cylinder head 720 is an oil passageway 771 in communication with the upper chamber 760 and also in communication with a one-way valve 775 mounted in the cylinder head 770. Also provided in the cylinder head 770 on the other side thereof is an oil passageway 772 in communication with the upper chamber 760 and in communication with a pressure release valve 790.

A one-way valve 780 is mounted in the outer sleeve 745 in communication with the passageway 749 and hence with the lower chamber 765, the one-way valve 775 and 780 being on the same side of the cylinder 720. A restrictor valve 785 having an aperture of small dimension therein (not shown) is mounted in the outer sleeve 745 in communication with a passageway 748 which in turn leads to the lower chamber 765, the restrictor valve 785 also being in communication with the passageway 752 leading to the crank case 710.

A combustion chamber 800 is defined between the inner surface of the top portion 726 of the inner sleeve 725 and the piston 705. A standard spark plug 805 positioned in the usual manner in the spark plug seat 727, extends into the combustion chamber 800 and operates in the usual manner. An exhaust system 810 is in fluid communication with the interior of the cylinder 720 by means of the aligned apertures 736 and 756. Finally, a carburetor 806 is in fluid communication with the aligned ports or passageways 755 and 735, thereby to provide air flow to the interior of the cylinders 720 and particularly to the combustion chamber 800.

A conduit 816 interconnects the pressure release valve 790 and the crank case 710 and a conduit 817 interconnects the one-way valve 785 and the crank case and particularly, the passageway 752 extending through the outer sleeve 745 and the crank case. An oil pump (not shown) provides a constant oil supply to the upper chamber 760 and the lower chamber 765, by providing a constant source of oil to the one-way valves 775 and 780. The conduits between the crank case 710 and the aforementioned one-way valves 775 and 780 are not shown for clarity, but the continuous hydraulic loop between the crank case 710 and is chambers 760 and 765 is provided.

Operation of the motor 700 is substantially the same as other non-rotating, bouncing piston engine motors, well known in the art. Since the piston reciprocates with no rotary motion involved, the pairs of cylinders 720 and the combustion chambers 800 cooperate so that there is combustion in one chamber and compression in another chamber.

As described, the aforementioned VCR concept, is adaptable to engines of many types and descriptions, the principle novel feature being the provision of the inner and outer sleeves providing relative movement therebetween automatically in response to varying engine loads. The concept provides further advantages in that difficult sealing problems are not encountered and that engine modification is made easy by the lack of sophisticated and complex machinery required to incorporate the present system into standard engines. The advantages of VCR engines have been described in the literature and in particular in a paper entitled "A Variable Compression Ratio Engine Development" by W. A. Wallace and F. B. Lux, given in an SAE meeting, Oct. 14 to 17, 1963, in Chicago, Ill., SAE pamphlet number 762A.

A person skilled in the art will appreciate that the present two-part cylinders may be used to vary compression ratios over a large range depending on initial engine design and end use. Ratios may be varied through the ranges of 5 to 1 to 10 to 1, or from 11 to 1 to 22 to 1. The basic concept remains the same, but the cylinder dimensions determining final compression ratios. Relative movement between inner and outer cylindrical sleeves in combination with a unitary and sometimes integral cylinder head provides increased combustion efficiency and power with less loss of both gases and hydraulic fluid.

An alternative design is to vent the upper chamber to the lower chamber which can do away with the need for an independent source of oil to the lower chamber. Another feature of this invention is the change in effective area of the inlet and outlet ports during movement between the high compression and low compression conditions. Lower effective area is provided thereby in the high compression condition to conserve fuel and increase engine efficiency.

While there has been described what at present is considered to be the preferred embodiments of the present invention, it will be understood that various modifications and alterations may be made therein without departing from the true spirit and scope of the present invention and it is intended to cover such variations and modifications in the appended claims.

What is claimed is:

1. In an internal combustion engine having a combustion chamber, means for automatically varying the volume of the combustion chamber comprising, a cylinder having inner and outer sleeves, said inner sleeve defining at least a portion of the combustion chamber, first and second fluid chambers formed by said inner and outer sleeves, means connecting said first and second fluid chambers to a fluid supply to provide a constant source of fluid to said chambers, and means responsive to the pressure in the combustion chamber for varying the volume of fluid in said first and second chambers causing relative movement of said inner and outer sleeves to control the combustion chamber volume in response to pressure in the combustion chamber.

2. The internal combustion engine set forth in claim 1, wherein said inner sleeve is cylindrical with one end being closed and forming the combustion chamber with the associated piston.

3. The internal combustion engine set forth n claim 1, wherein said inner sleeve is movable and said outer sleeve is fixed.

4. The internal combustion engine set forth in claim 1, wherein said means for varying the fluid volume includes a restrictor valve in fluid communication with said first chamber for continually draining fluid therefrom.

5. The internal combustion engine set forth in claim 1, wherein said means for varying the fluid volume includes a pressure release valve in communication with said second chamber for preventing release of fluid from said second chamber until the pressure in the combustion chamber exceeds a predetermined value.

6. The internal combustion engine set forth in claim 5, wherein said pressure release valve is mounted on said outer sleeve.

7. The internal combustion engine set forth in claim 1, and further comprising means connecting said first and second chambers to an associated crankcase to provide a continuous and closed loop between said chambers and the crankcase.

8. The internal combustion engine set forth in claim 1, wherein said means connecting said chamber to the fluid supply includes a one-way valve between the fluid source and each chamber.

9. The internal combustion engine set forth in claim 8, wherein said one-way valves are mounted on said outer sleeve.

10. The internal combustion engine set forth in claim 1, and further comprising a cylinder head mounted on said outer sleeve surrounding said inner sleeve.

11. In an internal combustion engine having a combustion chamber, means for automatically varying the volume of the combustion chamber comprising, a cylinder having a movable inner sleeve and a fixed outer sleeve, said inner sleeve having an integral closed end forming with an associated piston a unitary combustion chamber and having an outwardly extending annular portion, said outer sleeve having an inwardly extending annular portion the upper surface thereof mating with the lower surface of said inner sleeve annular portion, said inner and outer sleeves and the annular portions thereof in combination with a cylinder head forming upper and lower chambers, means connecting said upper and lower chambers to an associated source of fluid and providing fluid under pressure to said upper and lower chambers, means for maintaining the fluid in said upper chamber at a higher pressure than the fluid in said lower chamber when the engine load is less than a preselected value, and means for releasing the fluid in said upper chamber in response to an engine load in excess of said preselected value to permit relative movement between said inner and outer sleeves to increase the combustion chamber size, thereby decreasing the compression ratio.

12. The internal combustion engine set forth in claim 11, wherein said means for maintaining higher fluid pressure in said upper chamber includes a first valve for continually draining fluid from said lower chamber and a second valve for intermittently releasing fluid from said upper chamber in response to the pressure in the combustion chamber.

13. The internal combustion engine set forth in claim 11, wherein the vertical extent of movement by said inner cylinder is sufficient to reduce the compression ratio by a factor of two.

14. The internal combustion engine set forth in claim 11, wherein the annular portions of said inner and outer sleeves are abutting when the engine load is less than the preselected value to provide the smallest combustion chamber volume and the highest compression ratio.

* * * * *